United States Patent [19]

Lassche

[11] 4,245,376

[45] Jan. 20, 1981

[54] LOCK FOR SAFETY BELTS

[75] Inventor: Jakob Lassche, Dunningen, Fed. Rep. of Germany

[73] Assignee: Hugo Kern und Liebers & Co., Schramberg, Fed. Rep. of Germany

[21] Appl. No.: 921,060

[22] Filed: Jun. 30, 1978

[30] Foreign Application Priority Data

Jul. 8, 1977 [DE] Fed. Rep. of Germany ..... 2730885

[51] Int. Cl.[3] ..... A44B 19/00; A62B 35/00

[52] U.S. Cl. ..... 24/230 AL; 24/230 R; 297/468

[58] Field of Search ..... 24/230 AL, 230 R, 230 A, 24/230 AK; 297/468; 280/801

[56] References Cited

U.S. PATENT DOCUMENTS

| | | | |
|---|---|---|---|
| 3,201,840 | 8/1965 | Jantzen | 24/230 AL |
| 3,567,158 | 3/1971 | Coyle | 24/230 AK |
| 3,883,932 | 5/1975 | Meiller et al. | 24/230 A |
| 3,897,611 | 8/1975 | Booth | 24/230 R |
| 3,935,618 | 2/1976 | Fohl | 24/230 AL |
| 4,033,015 | 7/1977 | Uwe | 24/230 AL |
| 4,047,267 | 9/1977 | Lindblad | 24/230 AL |
| 4,064,603 | 12/1977 | Romanzi, Jr. | 24/230 A |
| 4,084,298 | 4/1978 | Fohl | 24/230 AL |
| 4,126,919 | 11/1978 | Lassche | 24/230 A |
| 4,134,186 | 1/1979 | Krautz | 24/230 A |

FOREIGN PATENT DOCUMENTS

| | | | |
|---|---|---|---|
| 2345593 | 3/1974 | Fed. Rep. of Germany | 24/230 AL |
| 2545768 | 4/1977 | Fed. Rep. of Germany | 24/230 AL |
| 1315413 | 12/1962 | France | 24/230 A |

*Primary Examiner*—James T. McCall

*Attorney, Agent, or Firm*—Lackenbach, Lilling & Siegel

[57] ABSTRACT

A lock for safety belts having a lock housing secured to a surface of a vehicle and an inner housing slideably located in the lock housing and held therein by spring tension. The lock is also provided with a latch tongue, insertable into the inner housing, and with a latch positioned within the inner housing adapted to engage a depression in the latch tongue under spring loading, with the latch tongue insertable into the inner housing, preventing the withdrawal of the latch tongue therefrom. A release key located on the lock housing is operable from the outside thereof; and said lock further comprises a lever pivotable on a pivot comprising part of said lock housing and engaged by said release key. Said lever bearing upon said latch and, upon depression of said release key, disengages the latch from the depression in said latch tongue, and a displacement of said inner housing against the loading of spring means moves the point of engagement of said latch by said lever towards the fixed pivot of said lever on said lock housing.

8 Claims, 5 Drawing Figures

LOCK FOR SAFETY BELTS

BACKGROUND OF THE INVENTION

The invention relates to a lock for safety belts, having a lock housing and an inner housing positioned within the lock housing and held in place by spring tension. A latch tongue is insertable into the inner housing and a latch is located within the inner housing, and is adapted to seat in a depression in the latch tongue, with the latch tongue inserted into the inner housing, and held there by spring tension, so as to prevent the withdrawal of the latch tongue from the inner housing. The lock housing is also provided with an externally operable key, journalled in the lock housing.

The lock has the function in seatbelts, as used to secure passengers in aircraft and surface vehicles, to reliably maintain the seatbelt in the buckled state under all conditions of loading, and to permit an easy opening of the seatbelt, when required to do so.

In seatbelt locks of the prior art, a spring-loaded latch, movably located within the lock housing, seats in a depression in the latch tongue. The release of the lock is accomplished through a key, slideably or pivotably located within the lock housing, which, upon actuation through pressure, lifts the latch out of the depression in the latch tongue against its spring loading, so that the latch tongue is released.

In the seatbelt lock defined in the introductory paragraph, as described in German Published Patent Application No. 2 345 593, the latch tongue is not inserted into the lock housing itself but into an inner housing, held reciprocably in the lock housing by means of strong tension springs. This capacity for lateral displacement is utilized in the known belt lock to arm an automatic release mechanism which opens the belt lock automatically, upon the lapse of a pre-determined time delay. The inner housing is displaced, with respect to the lock housing, under the influence of the strong tensile forces induced by the collision in an accident, and the release mechanism is armed. Should the tensile loading relax after the impact, the lock mechanism opens automatically—after a time delay of a few seconds, for reasons of safety—so that the belted person can free himself of the belt without difficulties, or may be released by others, even if unfamiliar with the belt mechanism, from the safety belt.

It is necessary, so that the safety belt may fulfill its function properly, that the opening of the lock may be accomplished with a small pressure load, imposed upon the release key. Only in such circumstances can the belt be opened without diffculty by a person injured in an accident, or by a fellow passenger. According to the latest guidelines, the pressure load required for opening should not exceed a maximum value of 6,000 grams.

This requirement can be met without difficulty, through the appropriate choice of the spring loading exerted on the latch, as long as the lock is not subjected to any tensile load.

In the event of an accident, however, strong tensile loads may be exerted on the lock. This may occur because the belted person may hang in the belt with his body weight, e.g. through being unconscious, or through the vehicle being upended as a consequence of the accident.

Even the automatic release mechanism, described in German Published Patent Application No. 2 345 593, only releases the belt lock when the tensile loading is removed. It is ensured therethrough, that an unconscious person—in a vehicle lying on its roof after the accident, for example—is retained in the safety belt until his body is lifted by helpers and the belt becomes unloaded. This has the consequence, however, in the event of a maintained tensile loading of the belt lock, such as may be occasioned by the deformation of the vehicle body or of the seat structure, in the accident, the automatic release mechanism does not come into play.

The latch is clamped into the depression of the latch tongue by these tensile loads imposed on the belt lock, so that a substantially larger pressure load must be developed on the release key to lift the latch out of the depression. It has been possible in the past, through suitable shaping of the latch and of the mating depression, to maintain the upper limit of 6,000 grams for the pressure load, as long as the tensile load on the belt lock does not exceed 30,000 grams. With higher tensile loads, the pressure load required to release locks of the prior art rises rapidly to values of 15,000 to 20,000 grams. Such loads can hardly be developed under favorable circumstances. Under the unfavorable circumstances of an accident the locks of the prior art cannot, for all practical consequences, be manually opened at tensile loadings exceeding 30,000 grams.

SUMMARY OF THE INVENTION

It is therefore an object of the invention to improve a lock of the type described in the opening paragraph of the disclosure, so that it may be opened without the development of a high pressure effort on the release key, even at high tensile loadings.

Other objects and advantages of the invention are attained in a lock of the previously described type, in accordance with the invention, in which the release key acts upon a lever, which is pivotable on a pivot fixed to the lock housing and lifts the latch out of the depression when the release key is actuated, and in which the point of engagement of the latch with respect to the lever is displaced towards the fixed pivot point of the lever, upon the displacement in the inner housing against the spring tension.

The belt lock of the invention permits manual release easily, even when large tensile loadings act upon the lock. A large tensile load acting upon the lock results in the displacement of the inner housing, against the spring load, inside the lock housing. The latch, positioned in the inner housing, is also displaced with respect to the release key, attached to the lock housing, and with respect to the lever operated thereby. Consequently, the point, at which the lever bears upon the latch, is also displaced, closer to the pivot point of the lever. In this manner the lever ratio is altered so that the force exerted on the latch increases, at the same force exerted on the release key, in comparison to the unloaded lock. Therefore, the lock-up of the latch, caused by the high tensile loading imposed on the lock, can be overcome, without the need to exert a force higher than the prescribed limit value of 6,000 grams on the release key.

The solution of the invention can be applied particularly simply and in a space-saving manner when the lever is formed as a simple lever, extending in only one direction from its pivot. The lever may be journalled at its pivot on the lock housing, or it may be supported loosely against a corresponding projection of the lock housing. The second possibility is to be strongly preferred, with reference to the low manufacturing costs and the simplified assembly.

In this case the lever need only be pushed onto a trunnion, projecting out from the release key, and can, thereafter, be introduced into the lock housing together with the key. The lever is then retained sideways between the release key and the wall of the lock housing. The positioning of the lever in its pivotal plane relies on contact, on one of its sides, with the latch, and is held against the supporting projection.

Two identical levers may be suitably employed, positioned symmetrically on both sides of the release key, so as to achieve a balanced loading action on the latch and prevent a tipping of the latch member.

BRIEF DESCRIPTION OF THE DRAWINGS

The invention will now be described with reference to to the enclosed drawings depicting preferred embodiments thereof, and wherein.

DESCRIPTION OF THE PREFERRED EMBODIMENTS

Figure 1:
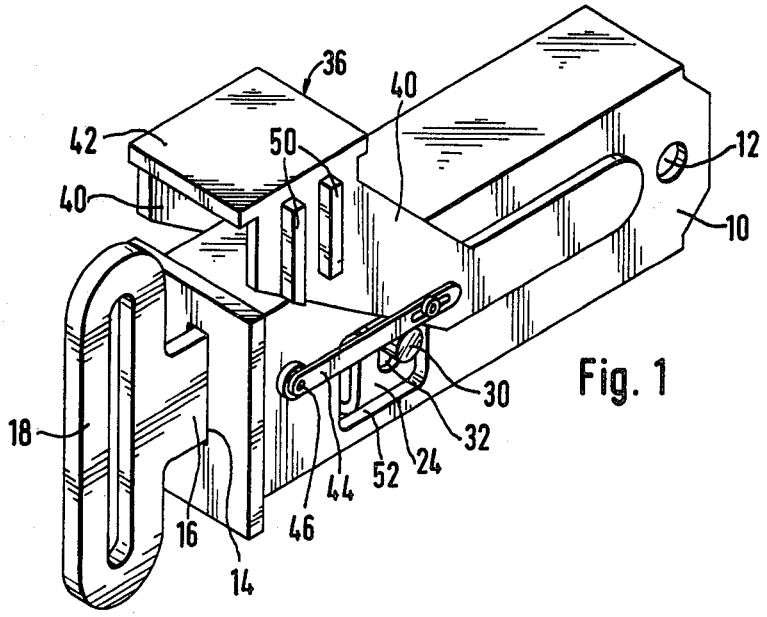
FIG. 1—is a perspective view of a belt lock constructed in accord with the invention.

A lock, or buckle assembly, is depicted in FIGS. 1 through 4 which corresponds, in most components, to that known from U.S. Pat. No. 4,126,919, granted to Jakob Lassche, which corresponds to German Published Patent Application No. 2 345 593. So as to simplify the illustration, components associated with the time-delayed release of the latch are omitted and some components which are not involved in the improvement of the invention are depicted schematically.

The belt lock is composed of a lock housing 10, which may be secured to a vehicle, an automobile, for example, by means of orifice 12. The lock housing is contained within a sheath, which is omitted from the illustration, which is adapted to particular assembly conditions.

The lock housing is provided with a funnel-like entry channel 14, at the end opposite to that containing the orifice 12. A latch tongue 16 may be inserted into the entry channel 14; and a safety belt, not shown, is attached to the latch tongue by passage through the elongated slot 18.

The forward end of the latch tongue 16 is provided with angled alignment ramps 20 and, adjacent thereto, with lateral depressions 22. The alignment ramps 20 and the depressions 22 are constructed in a symmetrical manner, with reference to the longitudinal axis of the latch tongue 16, so that the latch tongue may be led into the buckle independently of its accidental orientation.

An inner housing 24 is provided inside the lock housing 10 and is slidable along the longitudinal axis thereof. The inner housing 24 is secured within the lock housing 10 by strong tension springs 26 which are anchored to projections 28 affixed in lock housing 10.

A latch 30 is located within the inner housing 24 and passes therethrough in a direction transverse to the longitudinal axis of the inner housing. The latch is slideably positioned in elongated orifices 32 piercing the inner housing 24 and is biased against the upper limits of the elongated orifices 32, in the attitude of the drawing, by means of a spring 34 bearing against the inner housing 24. The shapes of the latch 30, of the elongated orifices 32, and of the spring 34 are only shown in schematic form in the drawing, for the sake of simplicity, and may be adapted in any suitable manner to specific requirements.

Upon the introduction of the latch tongue 16 into the entry channel 14 of the lock housing 10, the frontal portion of the latch tongue 16 is received into the inner housing 24. As the latch tongue 16 slides into the buckle assembly, the angled alignment ramp 20 at its forward end presses the latch 30 down, in the drawing, against the force of the spring 34. Upon further introduction of the latch tongue 16 the latch 30 comes opposite the depression 22 and seats thereinto under the influence of the spring 34. Consequently, the latch 30 secures the latch tongue 16 to the inner housing 24 and prevents the drawing out of the latch tongue 16 and the opening of the belt lock.

A release key 36 is provided for the manual opening of the belt lock. The release key 36 encompasses the lock housing 10 symmetrically between two flanges 40. The flanges 40 are pivotably attached to the lock housing at pivot points 38. A lateral portion 42 of the release key 36 interconnects the two flanges 40 and can be operated from the outside of the external sheath; and it may be depressed to open the belt lock.

One end of a lever 44 is journalled to each of the flanges 40. The other end of each lever 44 is pivotably supported on pins 46 attached to the sides of lock housing 10. The levers 44 are superimposed on the ends of latch 30, which projects laterally out from the sides of the inner housing 24. The point of contact between the latch 30 and the levers 44 is, therefore, located intermediate between the pivot points of the levers 44 on the lock housing 10 and the release key 36.

Figure 2:
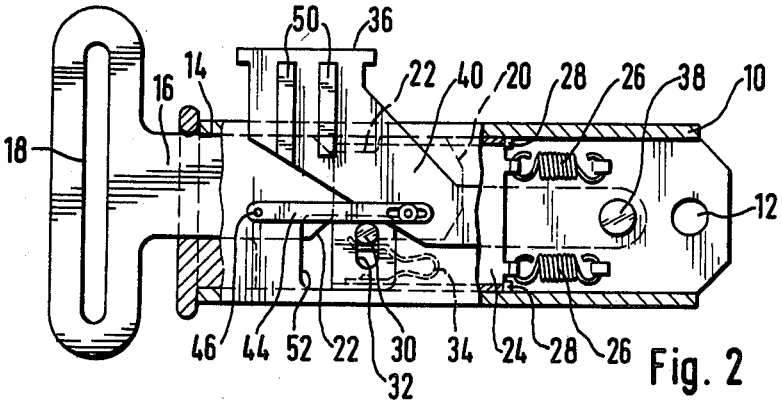
FIG. 2—is a side view of the belt lock of FIG. 1, in the locked condition, with a sidewall partly omitted in the illustration.

In the condition of the belt lock, shown in FIGS. 1 and 2, when the release key is not depressed, the latch 30 may seat completely in the depression 22 under the influence of a spring 34, unobstructed by the presence of the levers 44.

Figure 3:
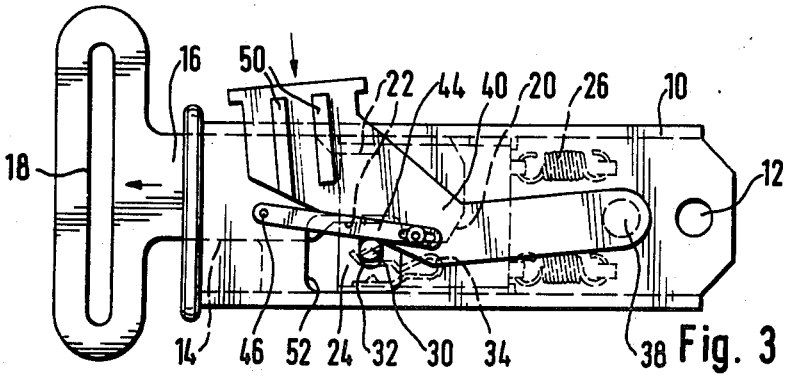
FIG. 3—is a side view of the belt lock with the release key depressed and in an unloaded condition.

On the other hand, when the release key is depressed, as shown in FIG. 3, and thereby displaced around the pivot points 38, the pivot points of the levers 44 are also displaced downwardly along with the release key 36.

In consequence, the levers 44 rotate on the pins 46 attached to the lock housing 10 pressing against the latch 30 thereby, and moving it, against the force of the springs 34, out of the depression 22. At this point, the latch tongue 16 may be withdrawn from the inner housing 24 and the belt lock is opened.

On the sides of the flanges 40 of the release key 36 rails 50 may be provided so as to bear, additionally, against the levers 44 upon the depression of the release key 36.

It is also possible to guide the release key linearly in the outer sheath (not shown) of the buckle assembly enclosing the lock housing 10, by means of such rails 50. In this case the release key 36 would not be pivoted at pivots 38, as shown, but are reciprocably retained in linear guide slots in the outer sheath corresponding to the rails 50.

In addition to the described mode of manual opening, the belt lock can also be released automatically after a collision and the imposition of a momentary high tensile loading. For this purpose a mechanism, not illustrated, is provided, as described in U.S. Pat. No. 4,126,919, granted to Jakob Lassche, which corresponds to German Published Patent Application No. 2 345 593. This mechanism provides for a lifting of the latch 30 out of the depression 22, against the force of the spring 34, even with the release key in the inoperative position, as best illustrated in FIGS. 1 and 2.

As may be readily seen in FIGS. 1 through 3, the provision of levers 44 reduces the compressive force which must be developed on portion 42 of the release key 36 in order to achieve the disengagement of latch 30 against the force of spring 34.

The force which has to be developed on release key 36 is reduced proportionately to the lengths between the point of support of the lever 44 on the lock housing 10 and the point of contact with the latch 30, relative to the distance between the point of support and the pivot point on the release key 36.

Figure 4:
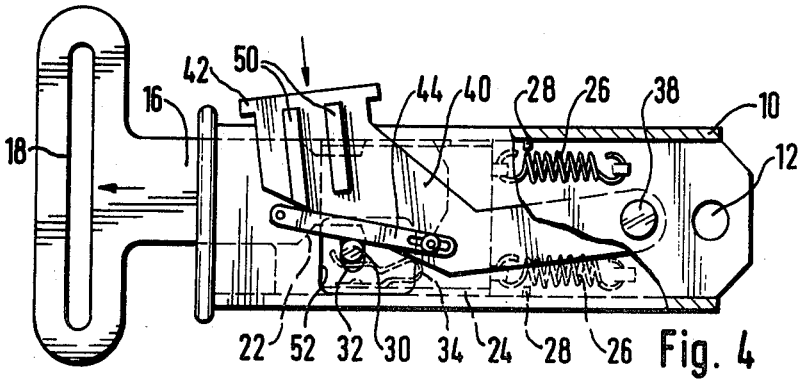
FIG. 4—is a side view of the belt lock with the release key depressed under conditions of an applied tensile load.

When the belt lock is subjected to an additional high tensile load—occasioned by a deformation of the seats in the vehicle of the body thereof, for example, or by a person hanging in the belt—the inner housing 24 is displaced the latch tongue 16, against the forces exerted by springs 26, as shown in FIG. 4. The latch 30 is also displaced along with the inner housing 24, in which it is located. So as to permit the displacement of the latch, a cutout 52, elongated in the axial direction, is provided in the lock housing 10 on each side.

Since the release key and the levers 44 are attached to the lock housing, this displacement of the inner housing 24 accomplishes a displacement of the latch 30 with respect to the lever 44. As shown in FIG. 4, the point at which the latch 30 contacts the levers 44 is displaced, in consequence, towards that end of each lever 44 which is pivotally attached to the lock housing 10. As a consequence thereof, the mechanical advantage between the release key 36 and the latch 30 is increased, through a reduction of the lever arm with which the levers 44 secure the lifting of the latch 30 from the depression 22, upon the actuation of the release key.

Therefore, the force which the levers exert on the latch 30 increases, without any corresponding increase in the force which is applied to the release key 36. The high clamping force between the latch 30 and the depression 22, resulting from the high tensile load, can, therefore, be overcome without an additional increment of force in the actuation of the key 36.

Figure 5:
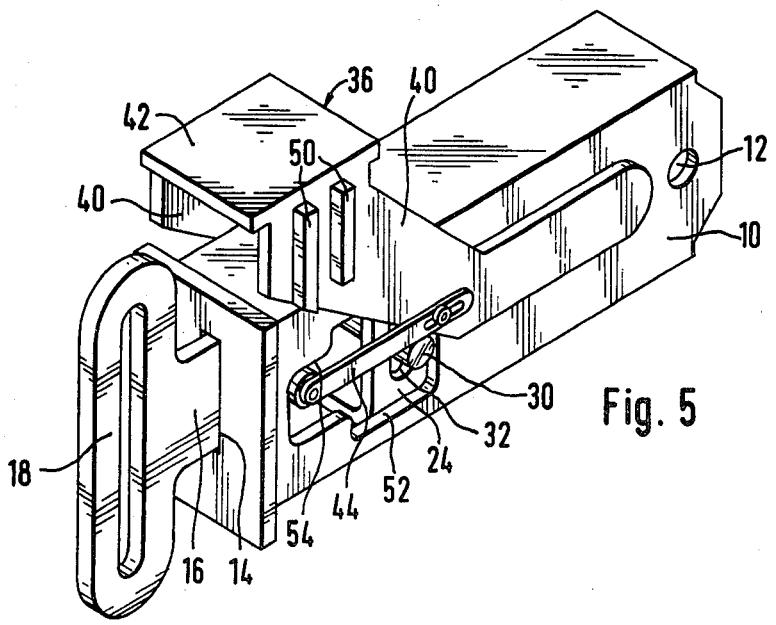
FIG. 5—is an alternate embodiment of the belt lock, shown in perspective view.

FIG. 5 depicts a modified embodiment of the belt lock of FIGS. 1 through 4. In contrast to the belt lock of FIGS. 1 through 4, the levers 44 are not secured to lock housing 10 by means of pins 46. Instead, the levers are supported, in a loose condition, on cam surfaces 54 provided in the sidewalls of the lock housing 10. The end of each lever 44 is held against the corresponding cam surface 54 by the spring-loaded latch 30.

This embodiment is simpler, in terms of manufacturing and assembly, than the embodiment of FIGS. 1 through 4. The levers need only be pushed onto the laterally projecting spindles on flanges 40 in this embodiment.

During the assembly of the belt lock the levers 44 are prevented from moving sidewise through the presence of the sidewalls of the external sheath. In their pivotal plane the levers 44 are constrained between the latch 30 and the fixed cam surfaces 54. A further restraint, necessitating assembly procedures, on the lever is, therefore, not required.

Although the present invention has been described in some detail by way of illustration and example for purposes of clarity of understanding, it will, of course, be understood that various changes and modifications may be made in the form, details, and arrangements of the parts without departing from the scope of the invention as set forth in the following claims.

I claim:

1. A lock for safety belts having a lock housing secured to a surface of a vehicle and an inner housing slideably located in said lock housing and held therein by spring tension; and provided with a latch tongue, insertable into said inner housing; and with a latch positioned within the inner housing adapted to engage a depression in said latch tongue under bias spring loading, with the latch tongue inserted into the inner housing, preventing the withdrawal of said latch tongue therefrom; and with a release key located on said lock housing and operable from the outside thereof; comprising:

a lever (44) pivotable on a pivot (46 or 54) comprising part of said lock housing (10) and engaged by said release key; wherein said lever (44) bears upon said latch (30) and, upon depression of said release key (36), disengages the latch (30) from said depression (22), and wherein a displacement of said inner housing (24) against the loading of spring means (26) moves the point of engagement of said latch by said lever toward the fixed pivot of said lever on said lock housing.

2. The lock of claim 1, wherein one end of said lever (44) is pivoted on said release key (36).

3. The lock of claim 2, wherein said lever is a simple lever and engages said latch (30) at a point of contact located intermediate between a pivot point (46, 54) of the lever on said lock housing and the pivot point on said release key (36).

4. The lock of claims 1, 2 or 3, wherein said lever (44) is journalled in said lock housing (10) at its pivot point (46).

5. The lock of claims 2 or 3, wherein said lever (44) is loosely supported against said lock housing (10) at its pivot point.

6. The lock of claims 1, 2 or 3, wherein said release key encompasses both faces of said latch tongue (16) symmetrically and bears upon two identical levers (44).

7. The lock of claim 6, wherein said two levers (44) are supported on pins projecting from opposing sides of said release key (36) and are held onto said pins by the wall of said lock housing (10).

8. The lock of claims 1 or 2, wherein a pair of levers (44) are supported in a loose condition, on cam surfaces (54) provided in the sidewalls of said lock housing (10), and the end of each said lever (44) is held against the corresponding cam surface (54) by said bias-loaded latch (30).

* * * * *